US006722042B1

(12) United States Patent
Naville, Jr. et al.

(10) Patent No.: US 6,722,042 B1
(45) Date of Patent: Apr. 20, 2004

(54) PUMPKIN DECORATIVE SURFACE CARVING TOOL

(75) Inventors: Earl J. Naville, Jr., Floyds Knobs, IN (US); Richard M. Haller, Elizabeth, IN (US); Phillip R. Masden, Floyds Knobs, IN (US)

(73) Assignee: Perfect Pumpkin Inc., Floyd Knobs, IN (US)

( * ) Notice: Subject to any disclaimer, the term of this patent is extended or adjusted under 35 U.S.C. 154(b) by 0 days.

(21) Appl. No.: 09/608,100

(22) Filed: Jun. 30, 2000

(51) Int. Cl.[7] ..... B26B 3/00; B26B 5/00

(52) U.S. Cl. ..... 30/280; 30/279.6; 30/317

(58) Field of Search ..... 30/169, 278, 279.2, 30/280, 294, 301, 305, 314, 315, 316, 317, 113.1, 279.6, 140, 121; D7/693

(56) References Cited

U.S. PATENT DOCUMENTS

| | | | | | |
|---|---|---|---|---|---|
| 339,542 | A | * | 4/1886 | Gates | 30/279.6 |
| 799,928 | A | * | 9/1905 | Nehr | 30/316 |
| 1,631,941 | A | * | 6/1927 | Straits | 30/280 |
| 2,785,463 | A | * | 3/1957 | Ager | 30/280 |
| 3,902,042 | A | * | 8/1975 | Goldfarb et al. | 30/140 |
| 3,965,574 | A | | 6/1976 | Graves | 30/289 |
| 4,277,891 | A | * | 7/1981 | Dick | 30/316 |
| 4,296,659 | A | | 10/1981 | Nauman | 30/315 |
| D268,639 | S | | 4/1983 | Johannsen | D7/143 |
| 4,383,367 | A | * | 5/1983 | Mielnicki | 30/280 |
| 4,689,885 | A | | 9/1987 | Albanese | 30/316 |
| 4,763,414 | A | * | 8/1988 | McNeill, II | 30/113.1 |
| 4,828,114 | A | | 5/1989 | Bardeen | 206/575 |
| 5,091,833 | A | | 2/1992 | Paniaguas et al. | 362/191 |
| 5,103,563 | A | * | 4/1992 | Johnson | 30/301 |
| 5,140,752 | A | * | 8/1992 | Kasprzak | 30/169 |
| D337,703 | S | | 7/1993 | Fox, Sr. | D6/675 |
| D369,070 | S | | 4/1996 | Hahn | D7/696 |
| 5,659,962 | A | * | 8/1997 | Tagou | 30/279.6 |
| 5,720,991 | A | * | 2/1998 | Gildersleeve et al. | 30/301 |
| 5,933,968 | A | | 8/1999 | Solomon | 30/358 |
| 6,009,625 | A | * | 1/2000 | Keathley | 30/301 |

* cited by examiner

*Primary Examiner*—Hwei-Siu Payer
(74) *Attorney, Agent, or Firm*—David W. Carrithers; Carrithers Law Office PLLC

(57) ABSTRACT

A pumpkin carving tool that has a cutter in the form of a loop projecting a selected distance from an edge of an open annular frame. In the simplest form the cutter is fixed to the frame. In an alternate embodiment the cutter is detachably mounted on the frame. The detachable cutter can be adjustably varied in the amount it projects from the frame to make different depths of carvings. The cutter is a narrow thin band of metal sharp enough to cut carvings in the outer surface of a pumpkin but not sharp enough to cut the users skin.

35 Claims, 5 Drawing Sheets

PUMPKIN DECORATIVE SURFACE CARVING TOOL

BACKGROUND OF THE INVENTION

1. Technical Field

This invention relates to surface decorative carving of pumpkins and more particularly, a tool for forming such decorative carvings.

2. Background Information

Decorative pumpkins are common at HALLOWEEN time and conventionally consist of openings cut in various shapes, locations D and sizes through the wall of a pumpkin shell to portray faces and/or shapes of various configurations such as a ("Jack-O-Lantern").

There are numerous known cutting tools and die for making the openings in a pumpkin shell. Anyone that has carved openings in a pumpkin will readily testify to the toughness of a pumpkin shell and because of this toughness the tools must be sharp and thus are sometimes dangerous to use. Some carving knives are serrated and require a lot of strength to use. Other conventional prior art devices define sharp die tools that need to be forced though the shell to form the openings. An obvious disadvantage is that for different configurations many such die are required.

The art of pumpkin decorating normally consists of removing the pulp and seeds and sometimes some of the flesh before proceeding with making the openings. The pumpkins are effectively destroyed in this decorating process because of the holes extending through the shell to the interior. Moreover, exposure of the pulp to the atmosphere results in decay and rotting of the pumpkin within a few days of preparation. By way of example of known tools, and the art of decorating pumpkins and making jack-o-lanterns, reference may be had to the following references: U.S. Des. Pat. No. D369,070 Granted Apr. 23, 1996 to M. Hahn; U.S. Des. Pat. No. D337,703 Granted Jul. 27, 1993 to D. Fox; and U.S. Des. Pat. No. D268,639 Granted Apr. 19, 1983 to R. Johannsen. The following utility patents also teach conventional tools and methods of cutting pumpkins. U.S. Pat. No. 5,933,968 granted Aug. 10, 1999 to A. Solomon; U.S. Pat. No. 5,091,833 granted Feb. 25, 1992 to J. Paniaguas et al; U.S. Pat. No. 4,828,114 granted May 9, 1989 to J. Bardeen; U.S. Pat. No. 4,689,885 granted Sep. 1, 1987 to T. Albanese; U.S. Pat. No. 4,296,659 granted Oct. 27, 1981 to C. Nauman; and U.S. Pat. No. 3,965,574 granted Jun. 29, 1976 to H. Graves.

SUMMARY OF THE INVENTION

The present invention provides of a carving tool for shaving the surface of an object comprising an open frame and a cutter mounted on and projecting a selected distance from the frame, wherein the cutter extends as a loop from the frame.

The preferred embodiment is designed to provide a holder and guide having a small metal blade to shave a surface carving in a pumpkin, gourd, cucumber, squash, fruits, vegetable, or other plant. The device could also be used for sculpturing wood, ice, plastic, or clay objects. The preferred embodiment utilizes a handle defining a frame as a means for holding a blade wherein the frame is designed to ride on the skin or surface of the pumpkin to enable the blade to extend into the pumpkin skin at a uniform selected depth throughout the carving. The blade, and preferably a pair of spaced apart blades project from the bottom of the frame.

The carving tool is designed to be small enough to hold in one hand. A preferred embodiment includes a central opening within the frame for enhancing the grip of the handle and providing an opening for easy pattern viewing. A handle having a generally elongated triangular shape with rounded corners provides good control, is hand friendly, an economical to mold. The tool may be held in the hand by grasping the handle sides with the thumb and middle finger to control side to side movement, while using the forefinger to pull the front end of the tool toward you along the pattern markings by viewing the tools guide marks.

The blades are typically from 0.01 to 0.03 inches thick and more preferably about 0.015 inches thick. The blades typically from about 0.1 to 0.3 inches wide and preferably about 0.125 inches wide. The blade is anchored in the front of the handle frame and may be molded into the frame or be manufactured separate from the frame and be secured thereto by snap in friction fits or other means of attachment. The length of the blade from the bottom of the tool will vary. Different blades have different depths and produce different effects. One preferred blade length is about 0.30 inches. The blades edge which carve the pumpkin are only sharp enough to cut pumpkin skin and not the users skin. Preferred blade shapes are the "V shape" and "U shape" blades. The "V shaped" blade is used to outline a desired pattern by first marking the pattern on the pumpkin's surface then by placing the "V shaped" blade at any point of the pattern and pulling it toward the user while gently pressing down on the tool allows the blade to penetrate the pumpkin until the tool frame rests on the pumpkin skin surface. The pattern can be viewed through the tool frame's open center wherein the pattern can be aligned with guide marks or indicia formed into or printed on the front end of the tool frame. The width of the "V shape" blade at the top where it is attached to the frame determines how small of a detail is possible.

The "U shape" blade is a wire or strip of metal forming a loop having a rounded or square bottom. The blade is placed in the outline pattern formed by the "V shape" blade carving and pulled along to form an outlined pattern having a uniform depth throughout the carving.

The tools preferably have all of the bottom edges rounded for smoother movement on the pumpkin's skin. The blade end of the tool preferably has a larger rounded bottom edge that is used to aid the exit from the pattern by rolling it with an upward movement of the handle end.

It is an object of the present invention to provide a tool to be used on a pumpkin that can remain unopened greatly extending the useable life of the pumpkin.

It is another object of the present invention to open the pumpkin cleaning out it's insides and using a light to create a low glow JACK-O-LANTERN with surface carvings.

An object of the present invention is to provide a tool for decorating pumpkins without it being destructive by forming shallow carvings on the outer surface of the pumpkin.

A further principal object of the present invention is to provide a hand tool for removing shallow portions of predetermined depth from the outer surface of a pumpkin.

A still further object of the present invention is to provide a tool for removing a narrow shallow portion from the outer surface of a pumpkin shell leaving a carving of selected uniform depth.

A further principal object of the present invention is to provide a tool for removing portions of various predetermined depth from the outer surface of a pumpkin.

A further principal object of the present invention is to provide a pumpkin carving tool that is selectively adjustable for carving different selected depths in the outer surface of the pumpkin.

Another object of the present invention is to utilize a cutting tool having a double blade jointed together for cutting a channel or groove from the surface of the pumpkin.

Another object of the present invention is to provide a cutting tool having a blade defining a thin strip of metal having a wedge shaped cutting edge which is sharp enough to cut a pumpkin skin, but will not cut the tool user's fingers.

It is another object of the present invention to provide a tool for cutting through the skin, or skin and pulp of a pumpkin, or selectively cutting a groove or channel of a desired depth through the skin and a portion of the pulp leaving a selected thickness of pulp after removal of the skin to aid in preservation of the pumpkin and to control the brightness, or illumination of light from a light source radiating from within the pumpkin through the carved skin and/or pulp cuts in the pumpkin.

It is another object of the present invention to provide a means for coloring or staining any pulp left remaining after removal of the rine to provide colored illuminance from a light source radiating from inside the pumpkin.

It is another object of the present invention to provide a means for sealing the exposed pulp after cutting such as with a wax or other petroleum or water based product in order to preserve the pumpkin after cutting for as much as six weeks allowing the pumpkins to be cut and sold prior to HALLOWEEN.

It is another object of the present invention to provide a cutter which could be used on watermelons, or other fruits and/or vegetables having a skin or rine covering a pulpy or fleshy body.

Another object of the present invention is for the tool to ride on the skin or surface of the pumpkin on either side on the blade for a uniform carving depth.

Another object of the present invention is to provide an open center within the handle or frame for viewing the pattern and guide marks on the tool for alignment.

Another object of the present invention is to provide for different blade depths by moving the blade up or down in the tools frame blade holding area.

Another object of the present invention is to provide a tool which can be used by pulling it toward the user.

Another object of the present invention is to provide a tool having interchangeable blades.

Another object of the present invention is to provide a tool which is safer than a knife or saw.

Another object of the present invention is to provide a tool for crating a surface carving without opening up the inside of the pumpkin to greatly increase the pumpkin's useable life.

Another object of the present invention is to provide a tool to create a carving which can be painted with craft paint or a glow in the dark coating.

Another object of the present invention is to provide a tool for creating surface carvings on a pumpkin allowing the pumpkin to be carved on all sides.

BRIEF DESCRIPTION OF THE DRAWINGS

A better understanding of the present invention will be had upon reference to the following description in conjunction with the accompanying drawings in which like numerals refer to like parts throughout the several views and wherein:

FIGS. 1 to 4, represent one embodiment of a pumpkin surface carving tool of the present invention in which a cutter is fixedly mounted on an open frame and wherein:

FIG. 1 is an oblique top view of an open frame with a "V"-shape cutter fixed thereto and projecting downwardly from the underside thereof;

FIG. 2 is an oblique bottom view in which the frame has a rectangular cutter projecting therefrom;

FIG. 3 is a plan view of a spacer mountable on the frame to adjust the depth of cut; and FIG. 4 is an elevational view of a longitudinal edge of the spacer shown in FIG. 3;

FIGS. 5 to 8 and 11 to 16 illustrate embodiments wherein the cutter is detachably mounted on an open frame and wherein:

FIG. 5 is a bottom view of a frame with a recess for receiving a cutter and cutter locking wedge;

FIG. 6 is an elevational view of the cutter receiving notch taken essentially along line 6—6 of FIG. 5 but on a larger scale;

FIG. 7 is an elevational view of a wedge to retain a cutter in grooves in the cutter receiving notch in the frame shown in FIG. 5;

FIG. 8 is a bottom view of FIG. 7;

FIG. 11 is an exploded view of a portion of a frame, cutter and cutter retainer;

FIG. 12 is an oblique view of the tool of FIG. 11 but in an assembled state;

FIG. 13 is a bottom view of a frame in which the cutter receiving notch shown in FIG. 5 is replaced by an aperture through the frame;

FIG. 14 is an elevational view of a wedge with grooves therein for the legs of a cutter and which slip fits into the aperture in the frame of FIG. 13;

FIG. 15 is a top plan view of FIG. 14; and

FIG. 16 is a left side elevational view of FIG. 15.

DETAILED DESCRIPTION OF THE PREFERRED EMBODIMENTS

Figure 1:
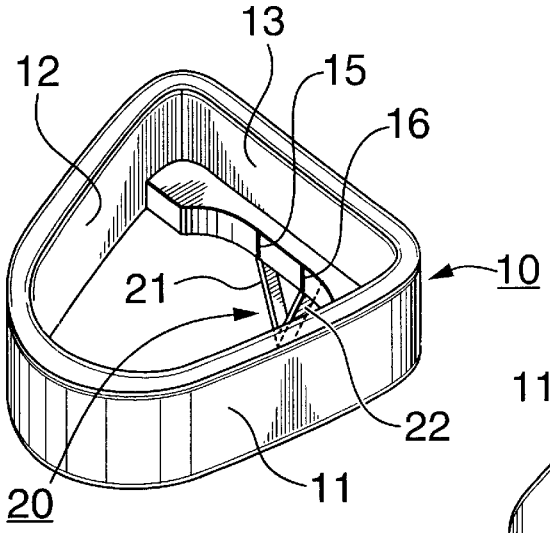

Illustrated in the drawing FIGS. 1–16 are various forms of cutters for carving out grooves in the outer face of a pumpkin through the rine or "skin" and pulp there below. Basically all of the embodiments include an open frame 10 that provides a handle and clear view of a pattern line made on the pumpkin surface prior to carving and a cutter 20 mounted on and projecting outwardly from the frame. The cutter 20 maybe fixedly mounted on the frame, as is illustrated in FIGS. 1 and 2, or detachably mounted as is the case with the preferred embodiments illustrated in FIGS. 5–8 and 11–16.

Figure 2:
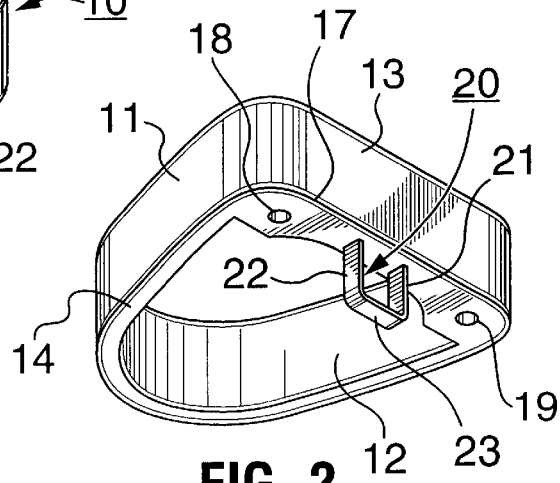
Figure 3:
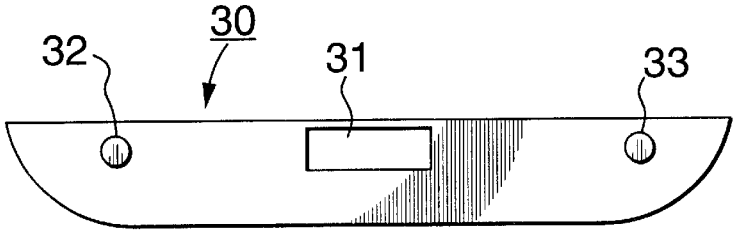
Figure 4:
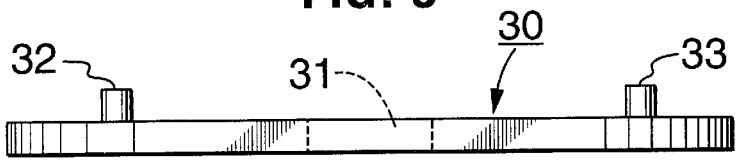

Referring to FIGS. 1 and 2 the frame 10 is an open or peripheral frame, triangular in shape, having legs 11, 12 and 13 and a bottom surface 14. The bottom surface rides over the surface of the pumpkin as the tool is moved by the user thereof pulling the cutter 20 through the skin and outer portion of the flesh.

Figure 10:
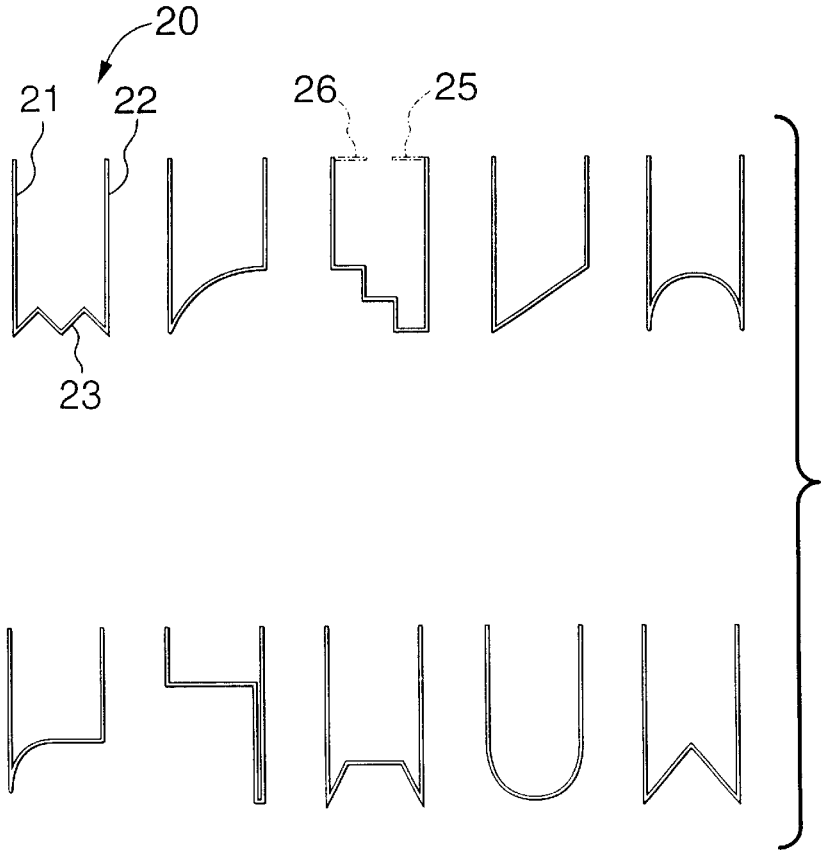
FIG. 10 are elevational views of a series of differently shaped cutters.

The cutter 20 is a narrow band of suitable material e.g. metal such as steel or stainless steel and is in the form of a loop comprising a pair of legs designated respectively 21 and 22 or a pair of legs 21 and 22 interconnected by a bite portion 23. A cutter having two legs is generally 'V'-shaped as is illustrated in FIG. 1 and where the legs are interconnected by a bite portion 23 the cutter is generally 'U'-shaped as is illustrated in FIG. 2. The bite portion 23 may be of various configurations some of which are illustrated in FIG. 10 and of different lengths providing various cutter widths as may be desired.

It is contemplated that blades may also be formed having a scalloped design, different thicknesses, or be formed having various other curvatures for carving particular designs. As shown in FIG. 10, the loop having a pair of legs and a bottom connecting portion forming a cutter may have multiple points extending downward therefrom, side edges of unequal length, curved or angled leg portions, and varied spacing between the legs.

The frame 10 is provided with a pair of guide marks designated respectively 15 and 16 aligned with the respective cutter legs 21 and 22. The frame 10 maybe be comprised of wood, metal such as aluminum or steel, or molded using a plastics material. In the preferred embodiment, the free ends of the legs 21 and 22 of the cutter embedded therein during molding providing a tool unit wherein the cutter is fixedly secured to the frame and projects a selected fixed distance therefrom.

The tool is held by grasping the frame legs 11 and 12 between the thumb and middle finger to control side to side movement while pulling the tool to slide it over the surface of the pumpkin. The index finger may be placed inside of the frame engaging it where the legs 11 and 12 merge into one another and is used to pull the tool toward the user thereof over the pumpkin surface. The open frame allows the user to see a line of a pattern previously made on the pumpkin surface and the guide marks 15 and 16 make it easy for one to follow the pattern line. The edges of the frame are eased i.e. rounded to facilitate moving and guiding the tool over the surface of the pumpkin in a controlled manner. The edge designated 17 can have a radius of suitable curvature to provide rolling contact with the pumpkin surface and serve as a fulcrum to facilitate removal of the cutter from the pumpkin and removal without tearing the pumpkin skin. Moreover, the cut or groove can extend completely through the pulp, or a predetermined distance therethrough to control the opacity or transmission of light through the pulp from a light source such as a battery powered light or candle.

The cutter or carving tool defines a blade which may be a thin strip of metal wedge shaped on one or both sides or may be formed as a wire. The carving tool may be selected from the group consisting of a single thin blade, a pair of thin blades spaced apart from one another, a single thin blade jointed bent forming a pair of blades having the distal ends attaching to said handle, a pair of blades extending from said handle spaced apart from one another joining at an end opposite said handle, a loop formed from a single thin blade, a single wire, a single wire forming a loop, a pair of wires spaced apart from one another, a pair of wires joining at an end opposite said handle, and a plurality of blades or wires extending from said handle.

The cutter, as previously mentioned is for example a wire or a strip of metal (steel or stainless steel) and by way of example be up to an two inches long, and preferably less than an inch long; and most preferably about 0.30 inches long. The cutter or blade is up to 0.5 inches wide and preferably about 0.125 inches wide; and up to about 0.2 inches thick and preferably from about 0.015 to 0.025 inches thick. The blade is sharp enough to cut the pumpkin skin but not the users skin and thus is a safe tool to use.

In the embodiment illustrated in FIGS. 1 and 2, the blade projects a fixed distance from the frame and this distance for example about 0.30 inches. In the embodiment illustrated in FIGS. 1 and 2 this depth of cut can be varied by using a spacer 30 illustrated in FIGS. 3 and 4 on the frame 10. The spacer 30 has an aperture 31 for the cutter to pass through and a spaced apart pair of pins 32 and 33 that project into respective recesses 18 and 19 in the bottom surface 14 of the frame leg 13. The inter-fitting pins and recesses stabilize the depth control spacer. Spacers of different thicknesses may be provided and used one spacer at a time or stacked to provide the desired depth of cut. For stacking, thin spacers having holes aligned with pins 31 and 32 may be interposed between the spacer 30 and the frame 10.

Figure 9:
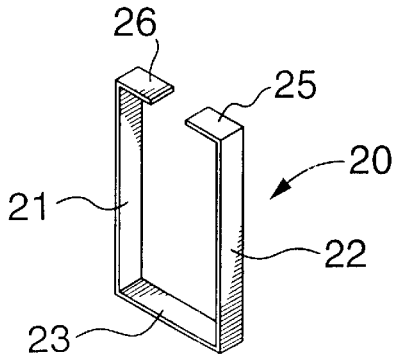
FIG. 9 is an oblique view of a cutter having legs removably insertable into grooves in the frame shown in detail in FIG. 6.
Figure 11:
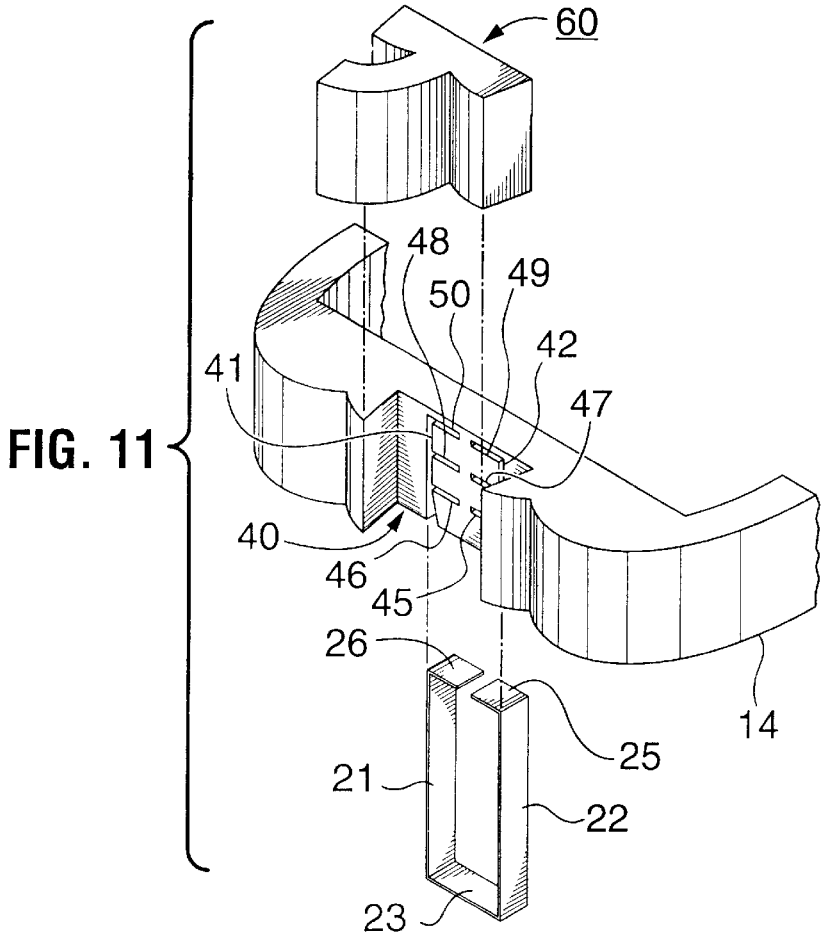

Referring to FIGS. 5, 6, 11 and 12 there is illustrated a tool frame having an integral or internal spacer arrangement wherein a cutter receiving notch 40 with a first pair of spaced apart grooves 41 and 42 for the respective cutter legs 21 and 22 as shown is FIG. 11 or in addition thereto a second pair of spaced apart grooves 43 and 44 for a cutter that has a longer bite portion 23. A cutter 20 for this frame is shown in FIG. 9 and at the top end of the respective cutter legs 21, 22, are inwardly turned cutter positioning lugs 25 and 26. Transverse to the grooves 41, 42 and 43, 44 are a first set of grooves 45, 46, a second set 47, 48 and a third set 49, 50. These sets of grooves are at different distances from the bottom surface 14 of the frame and receive the respective cutter positioning lugs 25, 26. By way of example the frame is preferably up to 4 inches across and designed to fit into and be held in one hand. Moreover, the preferred embodiment is approximately two (2) inches across and 0.6 inches deep and the first set of grooves 45, 46, the second set 47, 48 and the third set 49, 50 maybe spaced respectively 0.3, 0.425 and 0.550 inches from the bottom surface 14 of the frame and wherein the cutter legs 21 and 22 are approximately 0.625 inches.

The cutter legs 22, 23 fit into the pair of grooves 41, 42 or the pair of grooves 43, 44 depending upon the width of the cutter i.e. the length of the bite 23 and the lugs 25, 26 of the cutter fit into one of the grooves 45A, 47A or 49A depending upon the depth of penetration desired for the carving.

Figure 12:
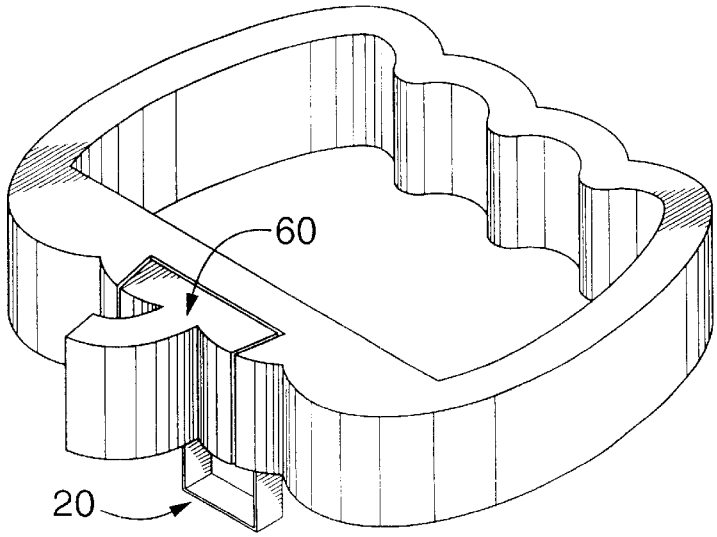

The cutter is locked in the frame by a wedge 60 which in the FIGS. 11 and 12 embodiment mates with the dovetail notch 40. The wedge can also taper slightly in a direction from one end toward the other to ensure a tight fit and also in such instance be inserted from the bottom edge 14 of the frame to ensure it stays in place during use of the tool.

It is contemplated that spacer(s) 30 can be used in combination with the internal spacer arrangement.

The frame maybe triangular as best illustrated in FIGS. (1, 2, 5, and 13) in shape or the shape of a pumpkin as is illustrated in FIGS. 11 and 12 or other shapes that are easily gripped by one hand.

Figure 7:
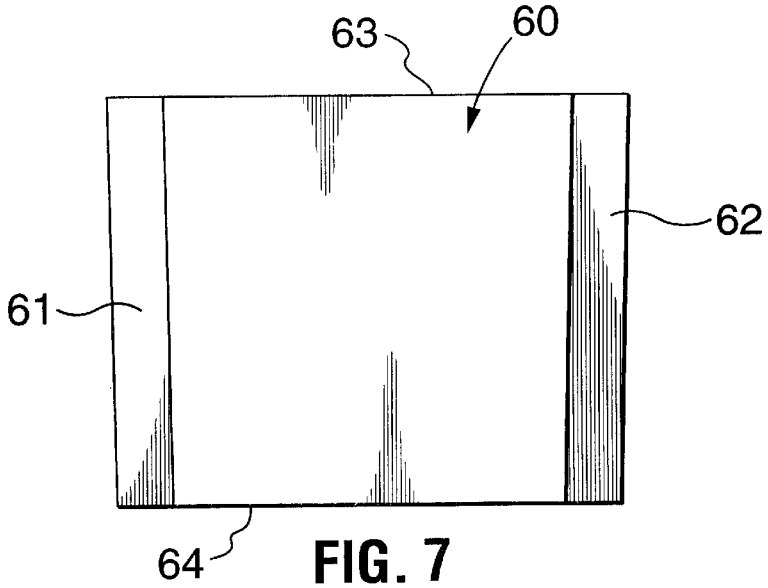
Figure 8:
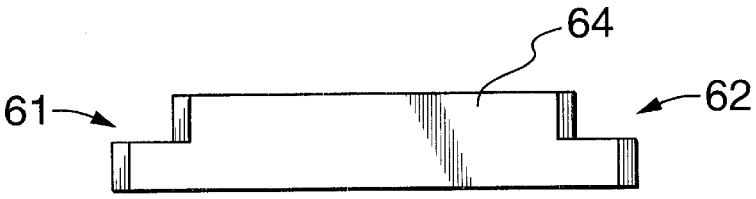

The cutter retaining wedge 60 shown in FIG. 7 has stepped respective opposite side edges 61 and 62 and these edges taper inwardly toward one another in a direction from one end 63 toward the opposite end 64. The notch 40 has correspondingly stepped and tapered edges to mate with the edges of the wedge.

In the embodiment illustrated in FIGS. 13 to 16 a wedge 60A slip fits into an aperture 40A in the frame. The wedge has in one face thereof, designated 65, the previously described groove arrangement in the frame for the cutter 20 shown in FIG. 9 except for the fact grooves 45 and 46 merge one into the other and in FIGS. 14 and 16 the merged grooves are designated 45A, as do the pair of grooves 47, 48 and are designated 47A and as do the pair of grooves 49, 50 and are designated 49A. The merging grooves permits using a cutter that is a closed loop i.e. an embodiment wherein the cutter lugs 25 and 26 merge into one another.

In this embodiment the wedge 60A, with a cutter as seen in FIG. 9 inserted in the grooves therefor, is inserted into the aperture 40A with the wedge face 65 facing the wall 41A of aperture 40A. In other words the wedge as viewed in FIG. 14 would have to be rotated 180 degrees about an axis parallel to the plane of the page and stood on its edge 64 so as to be in a position to be inserted into the wedge receiving aperture 40A.

The cutter legs 21, 22 fit into the pair of grooves 41, 42 or the pair of grooves 43, 44 depending upon the width of the cutter i.e. the length of the bite 24 and the lugs 25, 26 of the cutter fit into one of the grooves 45A, 47A or 49A depending upon the depth of penetration desired for the carving.

The wedge inserts from the bottom of the frame so that the pressure applied during carving helps keep the wedge in the aperture. As previously mentioned the mating stepped side edges taper inwardly toward one another in a direction from the bottom edge 14 of the frame toward the top edge.

Figure 5:
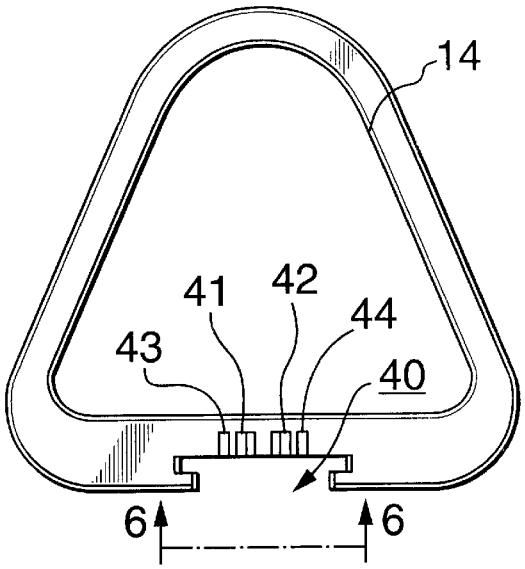
Figure 6:
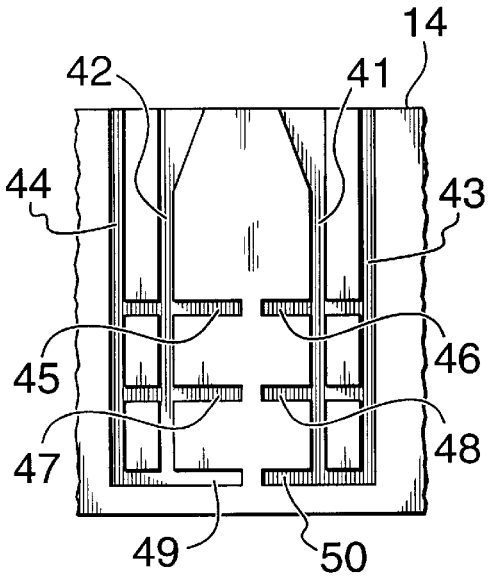
Figure 13:
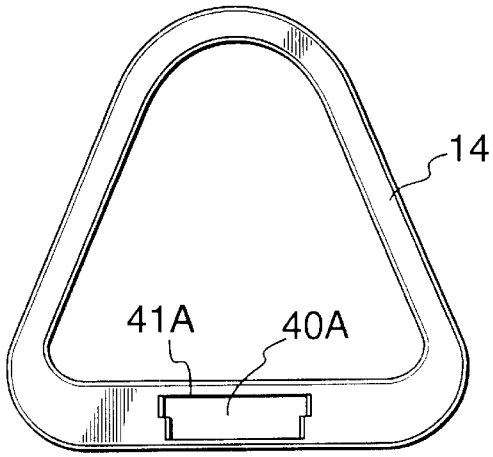
Figure 14:
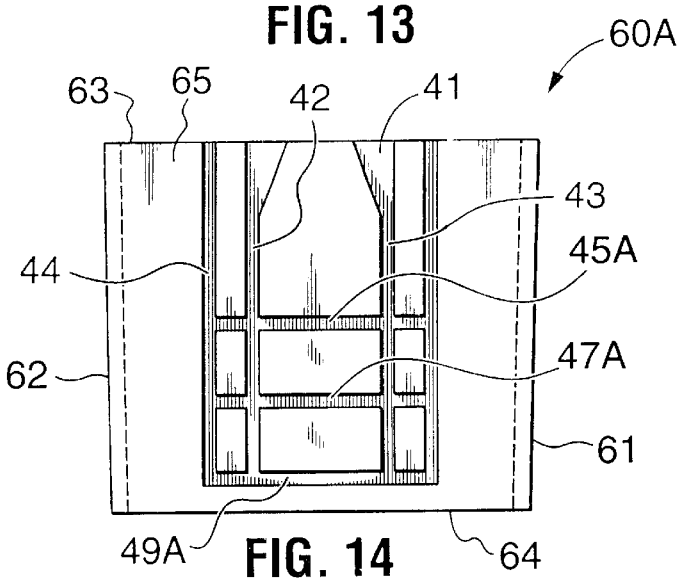
Figure 15:
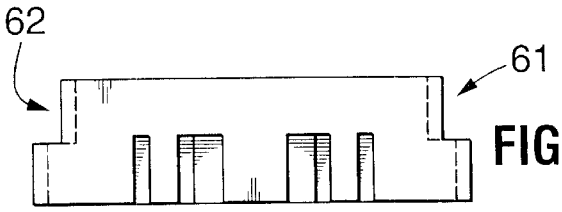
Figure 16:
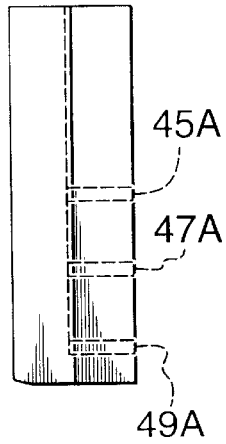

FIGS. 5 and 13 are bottom views and thus the frame with the wedge and cutter therein i.e. an assembled tool would be flipped over and be ready to be pulled over the surface of the pumpkin to start carving free style or following lines of a previously applied pattern.

Following the lines of an outlined pattern can itself provide an attractively decorated pumpkin. The shaved outline can be further enhanced by applying suitable coloring using non toxic dye. A suitable sealer such as petroleum jelly or the like can be applied to the carved surfaces thus preserving the pumpkin for weeks after cutting. Moreover, other sealers, such as comprising a latex or the like can be used to seal, retain moisture, and inhibit mold growth. A fungicide can also be mixed with other commercially available sealing agents to prevent mold growth. Furthermore, a dye, stain, or other coloring agents, preferably a GRAS, food grade dye can be used to dye or stain the exposed pulp before sealing. A flourescent dye or stain may be used to provide a glowing appearance to the pumpkin carving in day light, night, or low light conditions, wherein the light source selected for use within the pumpkin may provide a unique appearance. Furthermore, a black light or other exterior illumination light source may be used on the pumpkin including the dye to provide specialized effects.

The method of using the instant invention is simple. First, the 'V'-shaped cutter (or other selected shape cutter) is used to carve the outline of the pattern. The 'U'-shaped cutter may then optionally be used to shave the material from the remaining areas to be carved. By working from one side toward the other the frame rides on the outer face of the pumpkin thus carving to a uniform selected depth. A sealant may then be applied to the carving and/or the entire pumpkin as a preservative. It is contemplated that a stain or dye may be applied to the pulp remaining in the groove. Preferably a sealant would be applied over the stained portion(s) of the carving as well.

The carving tool of the present invention provides the ability to form decorative areas on the surface of the pumpkin while leaving the majority of the flesh as well as the interior in tack. This greatly extends the useful life of a pumpkin for later use as a food product or decorative item.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A carving tool for shaving a surface of an object comprising a frame defining a handle, means for supporting said frame on the surface of the object, and a cutter mounted on and projecting downwardly from said frame a selected distance from said frame, said cutter defining a loop comprising a narrow thin band of material having a thickness in the range of from 0.015 to 0.030 inches extending from said frame, said loop having a pair of distal ends spaced apart from one another and being fixedly secured to said frame, said loop defining a cutting edge for pulling toward a user;

said cutter has a spaced apart pair of legs, wherein a portion of said legs fit into grooves of said tool and means for holding defining a wedge removably insertable into said frame removably retaining said cutter thereon; and said grooves are located in said wedge.

2. The carving tool as defined in claim 1 wherein said thickness of sand band is approximately 0.020 inches.

3. The carving tool as defined in claim 1 wherein a portion of said legs fit into said grooves of said tool and means for holding defining a wedge removably insertable into said frame removably retaining said cutter thereon.

4. The carving tool as defined in claim 1 wherein said wedge is tapered inwardly in a direction from a bottom edge of said frame toward a top edge thereof.

5. A carving tool for shaving a surface of an object comprising an open frame defining a handle, and a cutter mounted on and projecting downwardly a selected distance from said open frame extending as a loop from said frame, said loop forming a cutting edge for pulling through said object toward a user, said open frame including a surface for resting on the surface of the object;

said cutter is detachably secured to said frame;

said cutter has a spaced apart pair of legs, wherein a portion of said legs fit into grooves of said tool and means for holding defining a wedge removably insertable into said frame removably retaining said cutter thereon; and said grooves are located in said wedge.

6. The carving tool as defined in claim 5 wherein said cutter comprises a narrow thin band of material having distal ends secured to said frame at spaced apart positions on said frame.

7. The carving tool as defined in claim 6 wherein said band has a thickness is in the range off from 0.015 to 0.025 inches.

8. The carving tool as defined in claim 7 wherein said thickness of said band is approximately 0.020 inches.

9. The carving tool as defined in claim 5 wherein said wedge is tapered inwardly in a direction from a top edge of said frame toward a bottom edge thereof.

10. The carving tool as defined in claim 5 wherein said cutter projects from said frame for up to three inches.

11. The carving tool as defined in claim 5 wherein said band has a thickness is up to 0.025 inches.

12. The carving tool as defined in claim 4 wherein said cutter extends from only one side of said frame.

13. The carving tool as defined in claim 5, wherein said frame is selected from a shape consisting of an annular frame, a triangular frame, and a pumpkin shaped frame.

14. A carving tool for shaving a surface of an object comprising an open frame defining a handle, and a cutter mounted on and projecting downwardly a selected distance from said open frame extending as a loop from said frame, said loop forming a cutting edge for pulling through said object toward a user, and said open frame including a surface for resting on the surface of the object;

said cutter is detachably mounted on said frame; and said cutter has a pair of spaced apart legs interconnected; at one end forming a loop, each one of said legs having a distal end cooperatively engaging a selected groove of said tool, said distal end of said leg terminating in a lug projecting inwardly.

15. The carving tool as defined in claim 14 wherein said cutter is secured to said frame.

16. The carving tool as defined in claim 14 wherein said cutter is adjustably mounted on said frame selectively to vary the depth of cut.

17. The carving tool as defined in claim 14 wherein said pair of legs are connected by a bottom portion forming a loop defining a shape selected from the group defining a 'V' shape, a 'U' shape, a scalloped design, blades having different thicknesses, a bottom connecting portion forming multiple points extending downward therefrom, legs of unequal length, curved legs, angled legs, and varied spacing between the legs.

18. A carving tool for shaving a surface of an object comprising an open frame defining a handle and including means for support on the surface of an object, and a cutter mounted on and projecting a selected distance from said frame, said cutter extending as a loop from said frame, said cutter comprising a narrow thin band of material having a pair of legs, each one having a distal end fixedly secured to said frame spaced apart from one another on said frame, said band of material having a thickness of up to 0.025 inches.

19. The carving tool as defined in claim 18 wherein said thickness of said band of material is approximately 0.020 inches.

20. The carving tool as defined in claim 18 wherein said loop defines a pair of legs interconnected by a bite portion, each of said pair of legs having a distal end fixedly secured to means for holding to said frame.

21. The carving tool as defined in claim 20, wherein said means for holding comprises a wedge removably insertable into at least one groove formed in said frame for removably retaining said cutter thereon.

22. The carving tool as defined in claim 21 wherein said wedge is tapered inwardly in a direction from a top edge of said frame toward a bottom edge thereof.

23. A carving tool for shaving a surface of an object comprising a frame defining a handle and including means for support on the surface of an object, and a cutter mounted on and projecting a selected distance from said frame, said cutter extending as a loop from said frame, said cutter comprising a narrow thin band of material having a pair of legs each one having a distal end fixedly secured to said frame spaced apart from one another positions on said frame, said band of material having a thickness of from 0.015 to 0.030 inches; and said frame is an open frame.

24. The carving tool as defined in claim 23 wherein said thickness of said band is approximately 0.020 inches.

25. The carving tool as defined in claim 23 wherein said pair of legs interconnected by a bite portion, each of said pair of legs having a distal end fixedly secured to means for holding to said frame.

26. The carving tool as defined in claim 23, including means for holding comprising a wedge removably insertable into at least one groove formed in said frame for removably retaining said cutter thereon.

27. The carving tool as defined in claim 26 wherein said wedge is tapered inwardly in a direction from a top edge of said frame toward a bottom edge thereof.

28. A carving tool for shaving a surface of an object comprising:

an open frame defining a handle, and a cutter mounting on and projecting a selected distance from said open frame, said cutter extending as a loop perpendicular from said frame;

said frame being selected from the group consisting of an annular frame, a triangular frame, and a pumpkin shaped frame;

said cutter being detachably mounted on said frame; and said cutter having a pair of spaced apart legs interconnected at one end forming a loop, each one of said legs having a distal end cooperatively engaging a selected groove of said tool, said distal end of said leg terminating in a lug projecting inwardly.

29. A carving tool for shaving a surface of an object comprising:

means for supporting said carving tool on the surface of the object comprising an open frame defining a handle;

a cutter mounted on and projecting a selected distance from said frame;

said cutter extending as a loop from said frame;

said cutter comprising a narrow thin band of material having a pair of legs each one having a distal end fixedly secured to said frame spaced apart from one another at a selected position on said frame.

30. The carving tool of claim 29, wherein said band of material is from 0.01 to 0.03 inches thick.

31. The carving tool of claim 29, wherein said band of material comprises a single thin blade jointed bent to form a loop and a pair of distal ends attaching to said handle or a pair of blades extending from said handle spaced apart from one another joining at an end forming a loop opposite said handle.

32. The carving tool of claim 29, wherein said band of material comprises a pair of legs spaced apart from one another and connected by a bottom portion forming a loop defining a shape selected from the group defining a 'V' shape, a 'U' shape, and a scalloped design.

33. A carving tool for shaving a surface of an object comprising:

means for supporting said carving tool on the surface of the object comprising an open frame defining a handle;

a cutter mounted on and projecting a selected distance from said frame;

said cutter extending as a wire loop from said frame comprising a pair of legs each one having a distal end fixedly secured to said frame spaced apart from one another at a selected position on said frame.

34. The carving tool of claim 33, wherein said wire loop is from 0.01 to 0.03 inches thick.

35. The carving tool of claim 33, wherein said wire loop comprises a pair of legs spaced apart from one another and connected by a bottom portion forming a loop defining a shape selected from the group defining a 'V' shape, a 'U' shape, and a scalloped design.

* * * * *